US006520358B1

(12) United States Patent
Kobayashi et al.

(10) Patent No.: US 6,520,358 B1
(45) Date of Patent: Feb. 18, 2003

(54) CRAWLER CRANE

(75) Inventors: Yutaka Kobayashi, Akashi (JP); Shozo Yokoyama, Akashi (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 09/421,218

(22) Filed: Oct. 20, 1999

(30) Foreign Application Priority Data

Oct. 29, 1998 (JP) ..... 10-309075

(51) Int. Cl.[7] ..... B66C 23/74
(52) U.S. Cl. ..... 212/195; 212/298; 212/299
(58) Field of Search ..... 212/239, 195, 212/261, 298, 299

(56) References Cited

U.S. PATENT DOCUMENTS

| | | | | | |
|---|---|---|---|---|---|
| 3,578,787 | A | * | 5/1971 | Brickett | 212/59 |
| 4,000,784 | A | * | 1/1977 | Morrow et al. | 180/9.84 |
| 4,081,081 | A | * | 3/1978 | Morrow et al. | 212/49 |
| 4,159,776 | A | * | 7/1979 | Holter | 212/339 |
| 4,194,638 | A | * | 3/1980 | Morrow et al. | 212/239 |
| 4,328,954 | A | * | 5/1982 | Logus | 254/344 |
| 4,336,889 | A | * | 6/1982 | McGrew | 212/178 |
| 4,421,241 | A | * | 12/1983 | Wittman et al. | 212/186 |
| 4,950,125 | A | | 8/1990 | Gravenhorst | |
| 5,484,069 | A | * | 1/1996 | Lanning | 212/270 |
| 5,598,935 | A | | 2/1997 | Harrison et al. | |
| 5,615,784 | A | * | 4/1997 | Pech et al. | 212/178 |
| 5,823,279 | A | | 10/1998 | Petzold | |

FOREIGN PATENT DOCUMENTS

| | | |
|---|---|---|
| DE | 25 54 910 | 6/1977 |
| EP | 0 048 076 | 3/1982 |
| EP | 0 533 499 | 3/1993 |
| EP | 0 869 099 | 10/1998 |
| GB | 2 048 201 | 12/1980 |
| GB | 2140772 | 12/1984 |
| JP | 9-25093 | * 1/1997 |

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

In the present crawler crane, an engine including a power plant for supplying driving pressure oil to a main winding drum, an auxiliary winding drum and a third drum is mounted on either left or right side of a revolving frame, a counterweight having a front side formed into a recessed surface is mounted at the rear of the main winding drum, the auxiliary winding drum and the third drum, and a boom rising and falling drum is installed within the recessed portion, thus making it possible to mount the third drum which has the same shape as the main winding drum and the auxiliary winding drum, for example. It is possible to provide a crawler crane capable of performing operation for versatile uses.

7 Claims, 11 Drawing Sheets

CRAWLER CRANE

BACKGROUND OF THE INVENTION

1. Field of the Invention

The present invention relates to a crawler crane capable of performing versatile operations.

2. Description of the Related Art

FIGS. 9 and 10 are a top view and a side view, respectively, of a conventional crawler crane 51. In this crane 51, a rigid revolving frame 54 is mounted to be traveled freely on a traveling rest provided with traveling crawlers 52 on both sides. A boom 55 for operation is mounted to be rocked back and forth on the extreme end of the revolving frame 54, and at the rear of the boom 55, a revolving device 56, a main (first) winding drum 57, an auxiliary (second) winding drum 58, and a third (third) drum 59 are arranged in a row to wind operating ropes. At the rear of the third drum 59 is arranged an engine 60 which drives a power plant comprising a hydraulic pump and the like not shown to supply pressure oil to the respective drums and also supply the driving force for revolution and traveling.

At the rear of the engine 60 is mounted a fall-down preventive counter-weight 61, front surface of which is flat so as not to interfere with the engine 60. On the other hand, on the frame projected on the left side forwardly of the revolving frame 54 is arranged a boom rising and falling drum 62 so as to wind a rope for rising and falling the boom 55. On the other hand, a cabin 63 is provided on the frame projected on the right side.

As shown in FIGS. 11A and 11B, each of the drums is braked by a dry brake 64 mounted on the side of the drum.

The crane 51 has various uses for operation, for example, such as a standard crane, a hammer-grab, a multiple wall bucket (hydraulic), a multiple wall bucket (mechanical), an earth drill, a clamshell, a logging, an earth auger, a down-the-hole, etc. In these operations, the vertical movement of a suspended load and a bucket is carried out by winding up and-down operation of the main winding drum 57 and the auxiliary winding drum 58 as standard equipment. On the other hand, casing jack handling in the hammer grab operation, vibro-at hand drawing in the vibro operation, crane operation in the operation on the vessel, and the like are carried out by the third drum 59 as optional equipment. The main winding drum 57 is used for opening and closing a clamshell bucket, the auxiliary winding drum 58 is used for supporting a clamshell bucket, and the third drum 59 is used for the installation crane operation such as tetra.

Generally, the crawler crane has restrictions in terms of body layout which is satisfied with the small rear end revolving radius required on the spot and which is necessary to mount a wide drum of large rope winding capacity. However, in the conventional crawler crane 51, when the third drum 59 is provided an optional equipment, only the third drum 59 which is smaller than the main winding drum 57 and the auxiliary winding drum 58 can be incorporated in terms of body layout as described above. Therefore, the diameter of a rope is so small in terms of restrictions of charge of a rope for the third drum 59 that multi-applying need be done when in raising, and the raising ability is restricted also. Accordingly, when the drum is used while adjusting to the use of operation, the third drum 59 exerts a considerable restriction on the use of operation.

Further, as shown in FIGS. 12 and 13, there is proposed a configuration 51' wherein the engine 60 is arranged on the side of the revolving frame 54. Large dry brakes 64' are provided doubly, as shown in FIGS. 14A and 14B, in order to secure the large braking force required for excavation operation or the like, and only the small third drum 59 can be incorporated. Note that other constitutions in FIGS. 12 to 14B are similar to those of the above-mentioned crawler crane 51, which are indicated by the same reference numerals.

SUMMARY OF THE INVENTION

It is an object of the present invention to provide a crawler crane capable of performing versatile operations.

The crawler crane according to the present invention comprises a revolving frame; a main winding drum, an auxiliary winding drum and a third drum mounted on said revolving frame to wind an operating rope, said drums being arranged in a row so that rotational shafts thereof are at right angles to a center shaft of a boom and mounted on said revolving frame; an engine including a power plant for supplying driving pressure oil to said main winding drum, said auxiliary winding drum and said third drum (said engine being mounted on either left or right side of said revolving frame); a counter-weight having a recess portion, front side of which is formed to have a recessed surface (said counter-weight being mounted at the rear of said main winding drum, said auxiliary winding drum and said third drum); and a boom accessory device installed within said recess portion.

In this case, the third drum of the size which is the same as or larger than said main winding drum and said auxiliary winding drum can be mounted on said revolving frame irrespective of the brake type of each of the drums. Therefore, the third drum is also able to obtain the raising ability which is the same as or greater than the main winding drum and the auxiliary winding drum. Drums can be selected for versatile operations by users.

In the conventional apparatus, the raising operation by the third drum has been carried out by multi-applying. In the present invention, however, the charge of the rope for the third drum increases, and the diameter of a rope for the third drum can be increased to reduce the number of applications for operation, thus enhancing the operating speed, and facilitating the charging operation for the rope. Further, since the third drum also can provide free falling similar to the main winding drum and the auxiliary winding drum.

Furthermore, the crawler crane according to the present invention comprises a revolving frame; a main winding drum, an auxiliary winding drum and a third drum mounted on said revolving frame to wind an operating rope, said drums being arranged in a row so that rotational shafts thereof are at right angles to a center shaft of a boom and mounted on said revolving frame; an engine including a power plant for supplying driving pressure oil to said main winding drum, said auxiliary winding drum and said third drum; and an encased type brake disposed on each drum to brake said main winding drum, said auxiliary drum and said third drum, respectively.

Since in this case, the third drum of the size which is the same as or larger than said main winding drum a said auxiliary drum can be mounted on said revolving frame irrespective of the shape of the counterweight, the third drum is also able to obtain the raising ability which is the same as or greater than the main winding drum and the auxiliary drum. Drums can be selected for versatile operations by users.

Moreover, if the constitutions of the above-mentioned crawler cranes are combined and applied, the geometrical operation and effect can be obtained advantageously.

DESCRIPTION OF THE PREFERRED EMBODIMENTS

The embodiments of the present invention will be described in detail hereinafter with reference to the accompanying drawings. The following embodiments show a concrete example of the present invention, by which the technical scope of the present invention is not limited.

Figure 1:
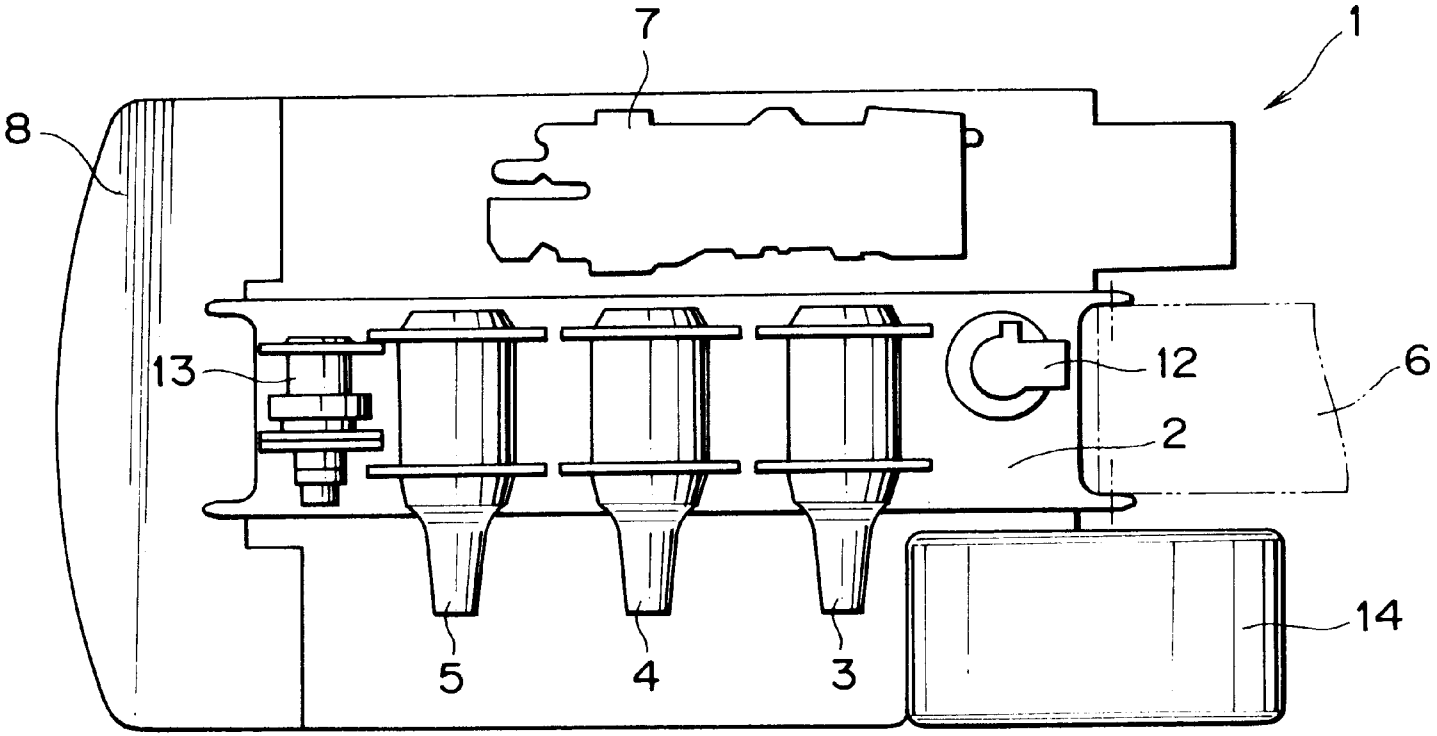
FIG. 1 is a top view showing a schematic constitution of a crawler crane according to one embodiment of the present invention.

FIG. 1 is a top view showing a schematic constitution of a crawler crane according to the present embodiment (hereinafter merely referred to as "a crawler crane"). As shown in FIG. 1, the present crawler crane is similar to that of prior art in that a main winding drum 3, an auxiliary winding drum 4, and a third drum 5 for winding an operating rope are arranged and mount in a row on a revolving frame 2 so that their rotational shafts are at right angles to a center axis of a boom 6. However, the present crawler crane is different from that of prior art in that ① an engine 7 including a power plant for supplying driving pressure oil to the main winding drum 3, the auxiliary winding drum 4 and the third drum 5 is mounted on either left or tight side of the revolving frame 2; ② a counterweight 8 having a front side formed so as to have a recessed surface is mounted at the rear of the main winding drum 3, the auxiliary winding drum 4 and the third drum 5, and a boom accessory device is installed within the recessed portion; and ③ a brake 9 encased in drum for braking the main winding drum 3, the auxiliary winding drum 4 and the third drum 5 is provided on each of the drums. The present crawler crane 1 may comprise a combination of the ① and ②, or a combination of the ① and ③ (in this case, the front side of the counterweight 8 may be any shape such as, flat), which case is also different from the prior art. In the following, a combination of ①, ② and ③ will be principally explained as an example.

Figure 2:
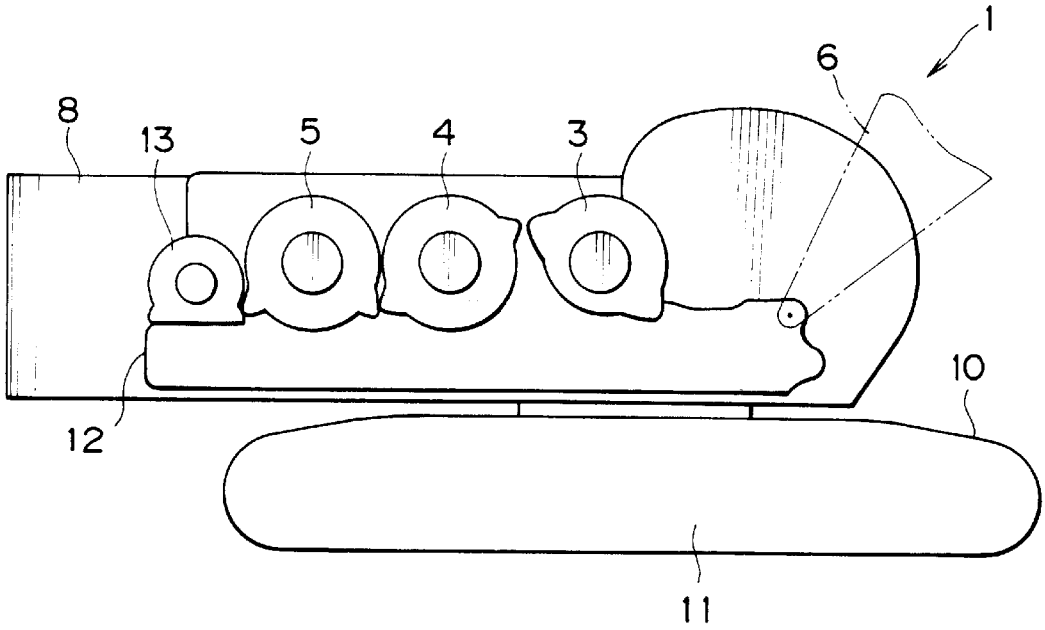
FIG. 2 is a side view showing a schematic constitution of a crawler crane according to one embodiment of the present invention.

FIGS. 1 and 2 are a top view and a side view, respectively, of the crawler crane 1. In these figures, in the present crawler crane 1, a revolving frame 2 is mounted to be revolved freely on a traveling rest 1 provided with traveling crawlers 10 on both sides. The revolving frame 2 of the present crawler crane 1 has a box construction having both longitudinal plates as a base to thereby provide a sufficient rigidity. A boom 6 for operation is mounted to be rocked freely back and forth on the extreme end of the revolving frame 2. At the rear of the boom 6, a revolving device 12, the main (first) winding drum 3, the auxiliary (second) winding drum 4 and the third (third) drum 5 are arranged in a row so as to wind the operating ropes.

In the present crawler crane 1, the engine 7 is arranged on the frame projected on the left side forwardly of the revolving frame 2. The power plant comprised of a hydraulic pump or the like not shown is driven by the engine 7 to supply pressure oil to the drums and also supply the driving force for revolution and traveling. A space is secured on the revolving frame 2 by the arrangement of the engine as described. However, by the mere lateral placement of the engine 7, a boom rising and falling drum 13 as an accessory device having been arranged previously becomes interfered with the engine 7 to make it impossible to realize such an arrangement as described.

In view of the foregoing, in the present crawler crane 1, the shape of a falling-preventive counterweight 8 mounted at the rear of the revolving frame 2 is formed so that the front surface is in the form of a recessed surface. The boom rising and falling drum 13 is arranged within the recessed portion so as to be put therein to wind a rising and falling rope of the boom 6. Because of the shape of the counterweight 8 as described, the boom rising and falling drum 13 can now be mounted at the further rear portion of the third drum 5. Accordingly, no interference between the boom rising and falling drum 13 and the engine 7 occurs any longer, and the engine 7 can be easily arranged on the frame projected to left of the revolving frame 2.

As a result, the main winding drum 3, the auxiliary winding drum 4 and the third drum 5 having the same shape, for example, can be mounted in a row on the revolving frame 2 so that their rotational shafts are at right angles to a center axis of the boom 6. Accordingly, three the same wind-up winch drums with a wind-down free falling function, among restrictions of the equal crane class and equal revolving rear end radius, can be mounted thus enhancing the operating efficiency and making uses of operation versatile.

A cabin 14 is provided on the frame projected to right forwardly of the revolving frame 2 so that an operator may perform various operations.

Figure 3:
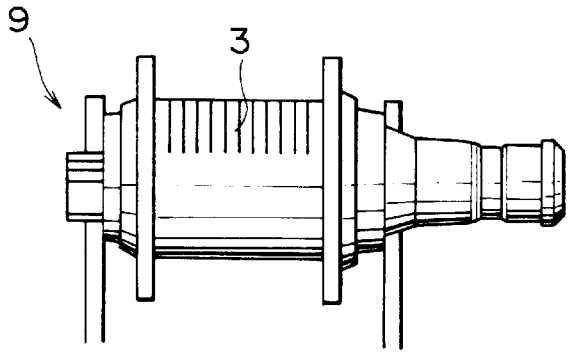
FIG. 3 is a fragmentary enlarged view of a main winding drum of the present crawler crane.

In the present crawler crane 1, each drum is braked by a wet brake 15 encased in drum, as shown in FIG. 3. The wet brake is provided so that for example, pressure oil is supplied to a brake of a multi-plate disk type to remove heat capacity emanated during braking. The reduction gear employed is also of the type encased in drum using, a planetary gear. With this, a projecting part such as a brake rim is not present, and the lateral arrangement of the engine becomes enabled. As a result, a space can be secured on the revolving frame 2, and the main winding drum 3, the auxiliary winding drum 4 and the third drum 5 having the same shape can be mounted in a row so that their rotational shafts are at right angles to a center axis of the boom 6. Accordingly, also in this case, three the same wind-up winch drums with a wind-down free falling function, among restrictions of the equal crane class and equal revolving rear end radius, can be mounted thus enhancing the operating efficiency and making uses of operation versatile.

Further, in this case, since the drum width is wider than the prior art, the winding capacity is increased, for example, when in the bucket operation, the winding drum can be operated smoothly, thus preventing the rope from being damaged. In addition thereto, assembling of parts around the brake and a maintenance space are no longer necessary. Accordingly, also from this aspect, three the same wind-up winch drums with a wind-down free falling function, among restrictions of the equal crane class and equal revolving rear end radius, can be mounted thus enhancing the operating efficiency. However, it is also possible to employ the dry brake similar to the prior art.

Further, in the present crawler crane 1, each drum is locked to the revolving frame 2 by means of a pin not shown whereby each drum can be detachably mounted on the revolving frame 2. With this, a position for mounting each drum can be suitably obtained, and a drum having a large diameter of a drum flange can be mounted according to operations. As described above, assembling and disassembling of each drum are further facilitated, as a consequence of which the shape of the revolving frame 2 is simplified to reduce the manufacturing cost thereof. However, it is also possible to employ bolting similar to the prior art.

Alternatively, the engine 7 can be arranged on the frame projected to right forwardly of the revolving frame 2, also in which case, operation and effect similar to those described above can be obtained. In this case, however, the cabin 14 is to be arranged on the frame projected to left of the revolving frame 2.

Figure 4:
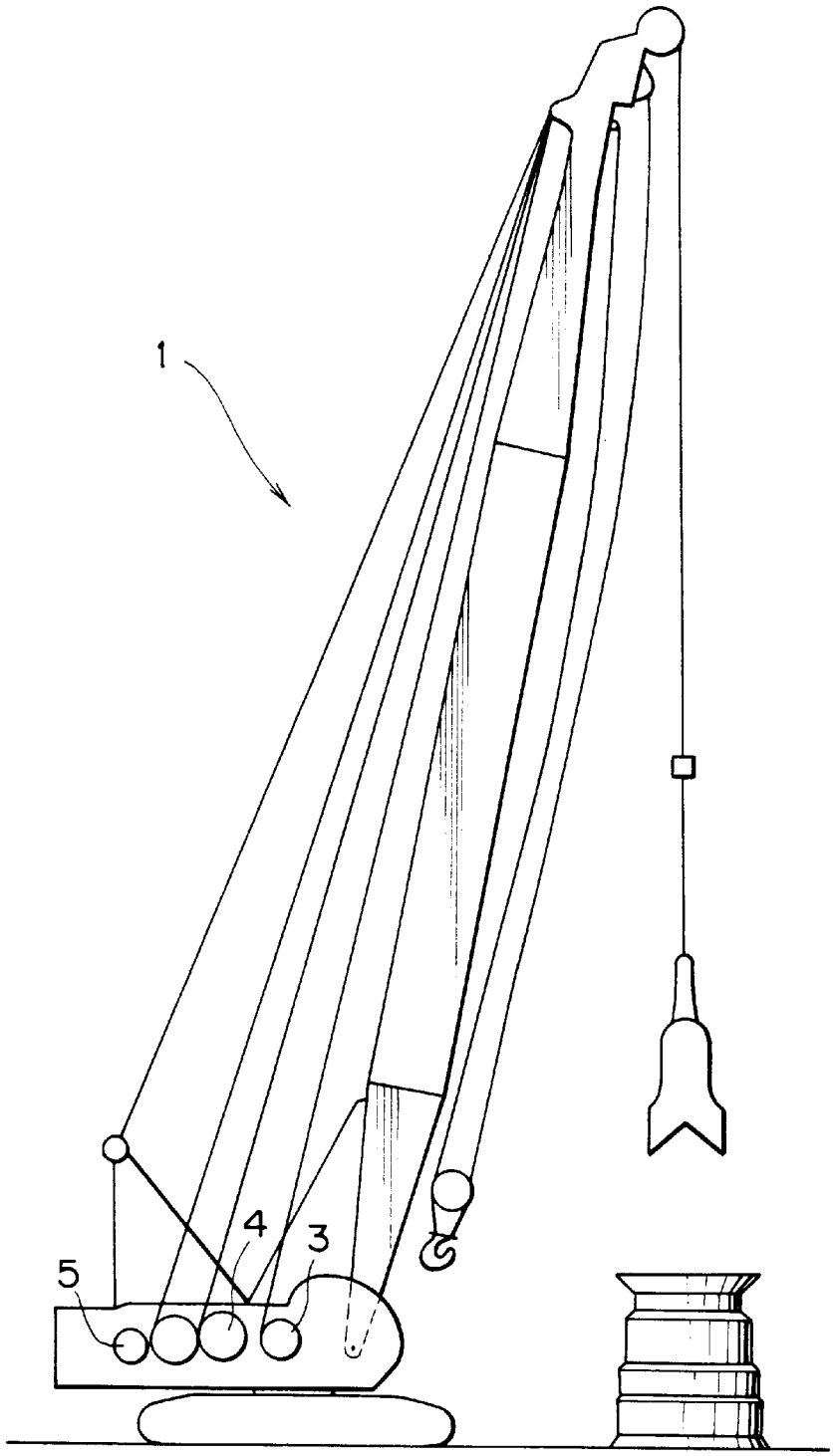
FIG. 4 is an explanatory view showing the schematic operation of the present crawler crane.

In the following, the operation of the present crawler crane 1 will be briefly explained. As shown in FIG. 4, for example, in the all casing operation (all revolving excavation), in the present crawler crane 1, the hammer grab opening and closing are carried out by crown operation effected by the main winding drum 3, and the hammer grab supporting is carried out by the auxiliary drum 4. The accompanying operation such as casing jack hanging is carried out by the third drum 5. By the cooperative operation of these drums, the casing jack is installed; the casing is set up; and the casing is internally excavated by the hammer grab, while the casing is being rotated and forced in by the casing jack, to make a post hole, concrete is poured therein to complete a post. That is, in a series of these operations, in the present crawler crane 1, the excavating operation is carried out by the main winding drum 3 and the auxiliary winding drum 4, and the handling of heavy weights can be carried out by the third drum 5 of the same size as the main winding drum and the auxiliary winding drum. Accordingly, since the diameter of a rope used in the operation effected by the third drum can be increased, less number of applications will suffice, and the speed of vertical movement of a suspending load can be also made higher. Being the wide drum, the bucket operation can be carried out with less number of applications to reduce the consumption of a rope. Further, since the same size of drums are used, the user can select a suitable drum as the main winding drum, the auxiliary winding drum or the third drum while adjusting to the uses of operation. Thereby, the same winding winch force, the same winding speed, and the same braking force are obtained, and the same rope can be used. Accordingly, even if one drum is in trouble, other drums can be used, as the urgent measures, to continue operation. Of course, the wind-down free falling operation effected by the drums can be easily carried out.

Figure 5:
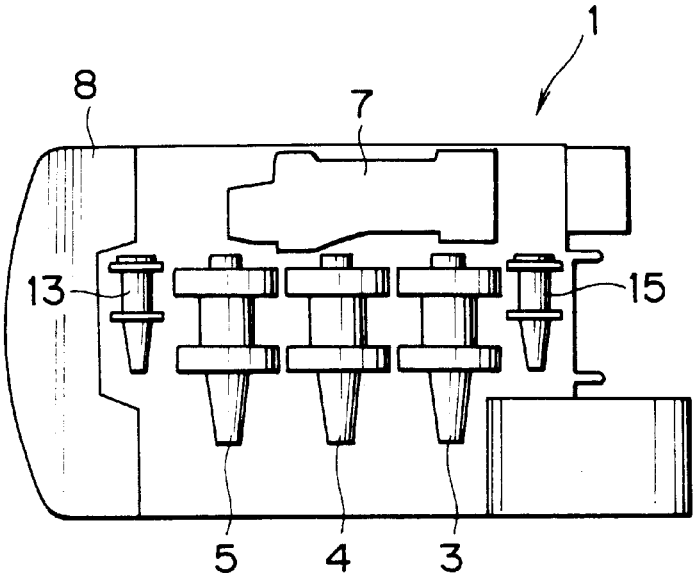
FIG. 5 is a top view of a crawler crane according to a further embodiment of the present invention.
Figure 6:
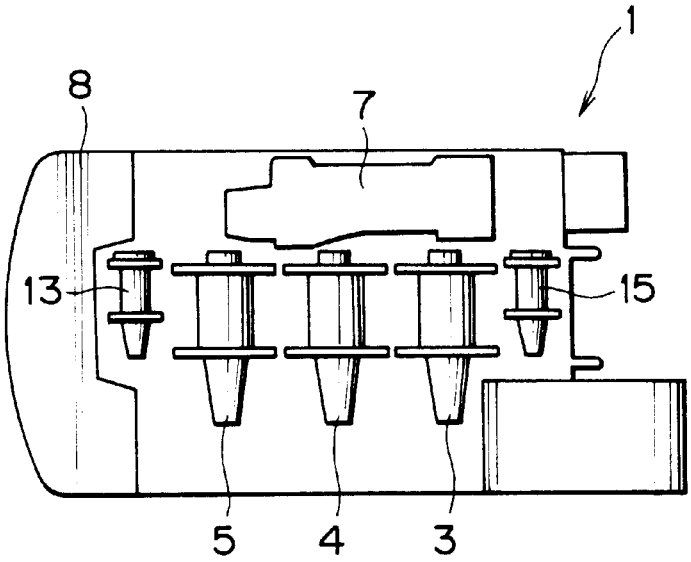
FIG. 6 is a top view of a crawler crane according to another embodiment of the present invention.
Figure 7:
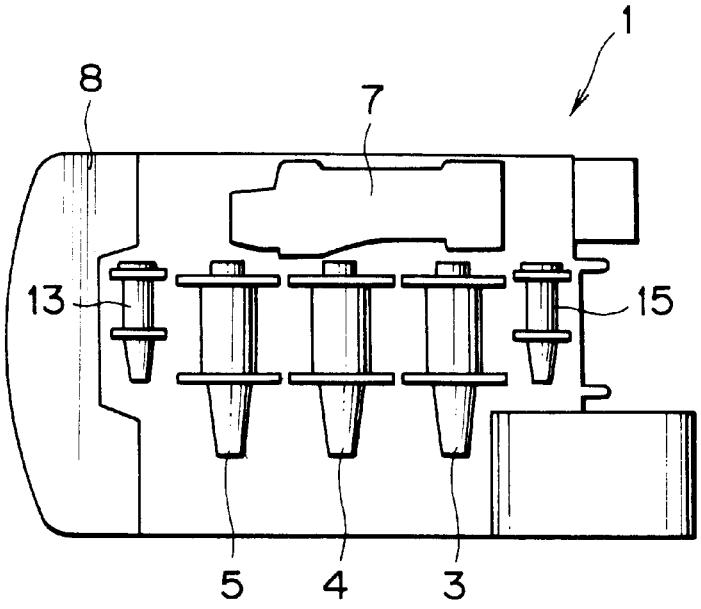
FIG. 7 is a top view of a crawler crane according to still another embodiment of the present invention.
Figure 8:
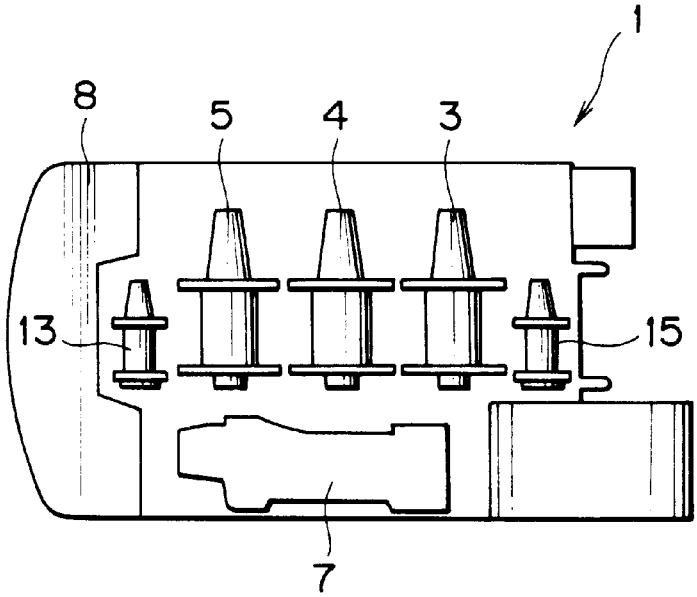
FIG. 8 is a top view of a crawler crane according to another embodiment of the present invention.
Figure 9:
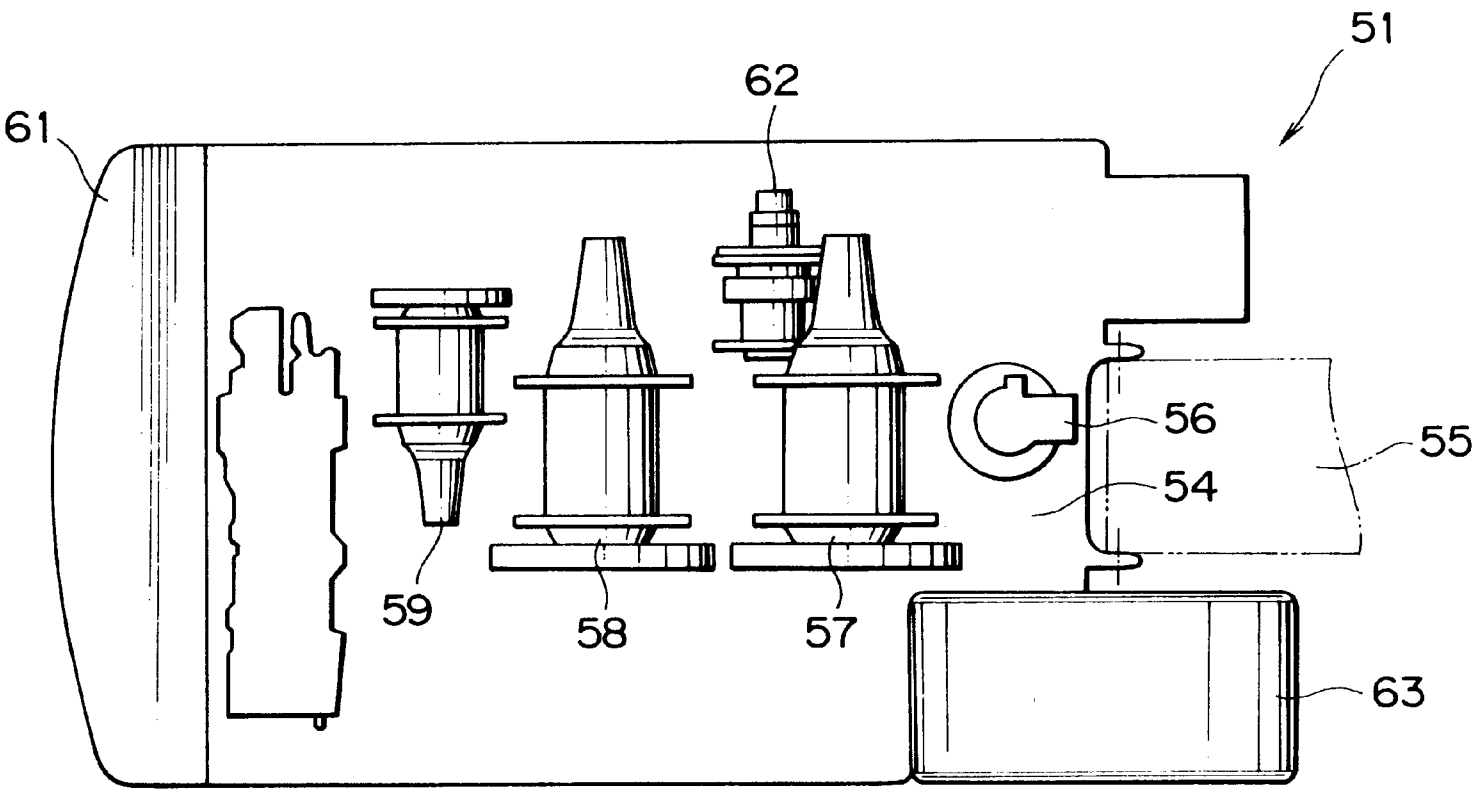
FIG. 9 PRIOR ART
FIG. 9 is a top view showing a schematic constitution of a crawler crane according to one example of a conventional crawler crane.
Figure 10:
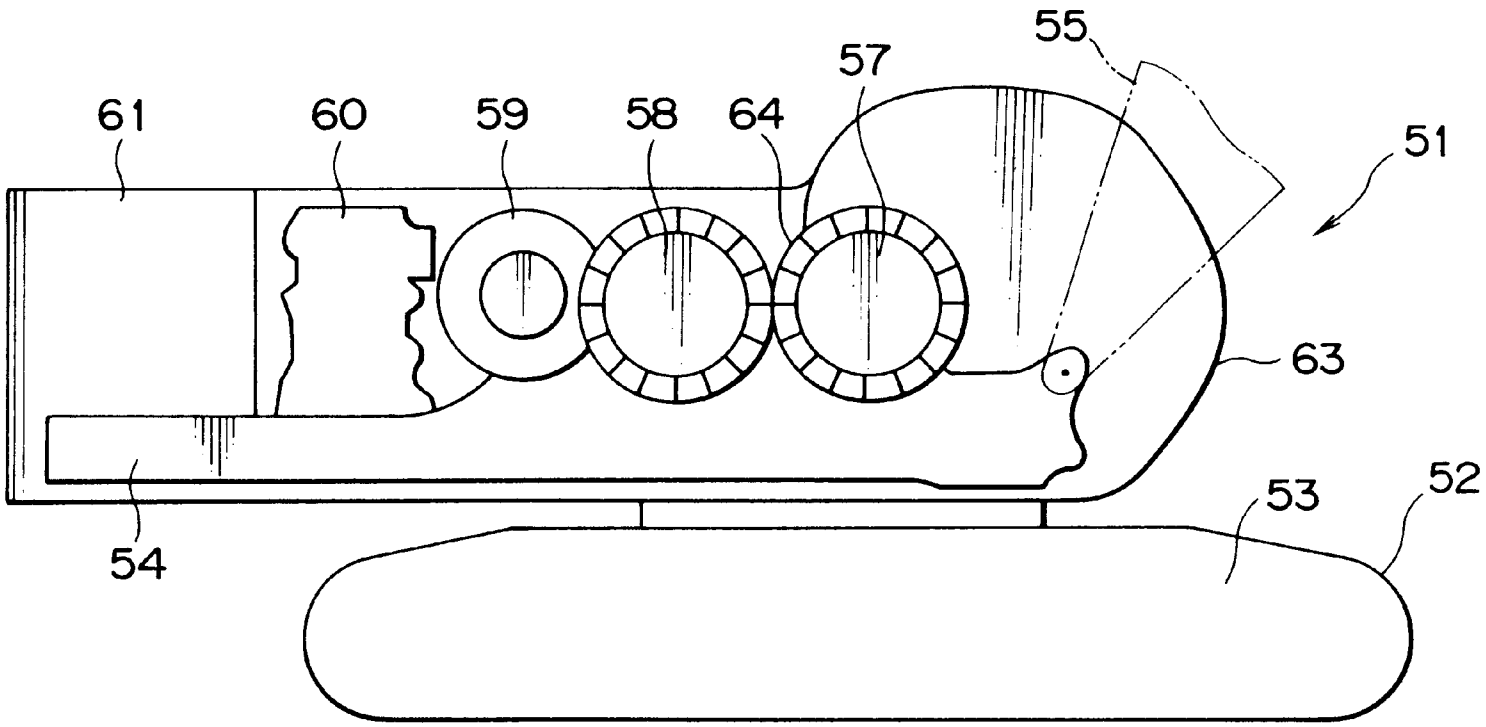
FIG. 10 PRIOR ART
FIG. 10 is a side view showing a schematic constitution of a crawler crane according to one example of a conventional crawler crane.
Figure 11A:
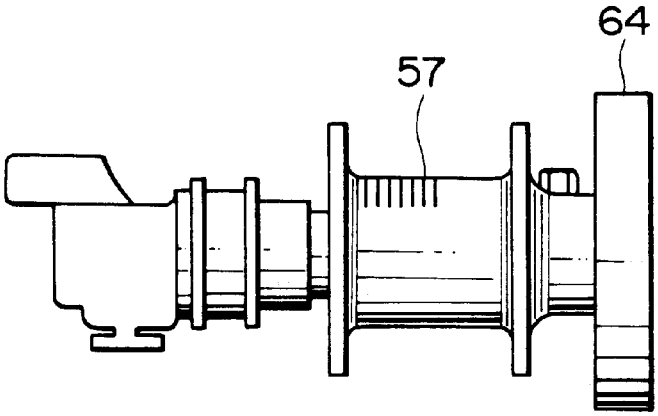
FIG. 11A PRIOR ART
FIGS. 11A and 11B are respectively a fragmentary enlarged view of a main winding drum according to one example of a conventional crawler crane.
Figure 11B:
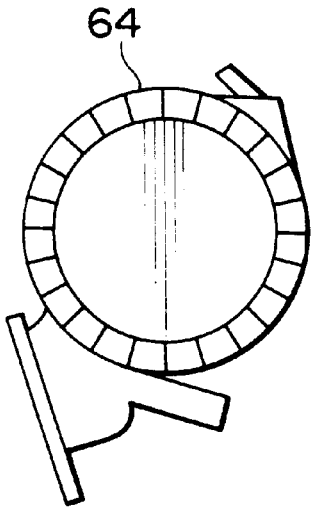
FIG. 11B PRIOR ART
Figure 12:
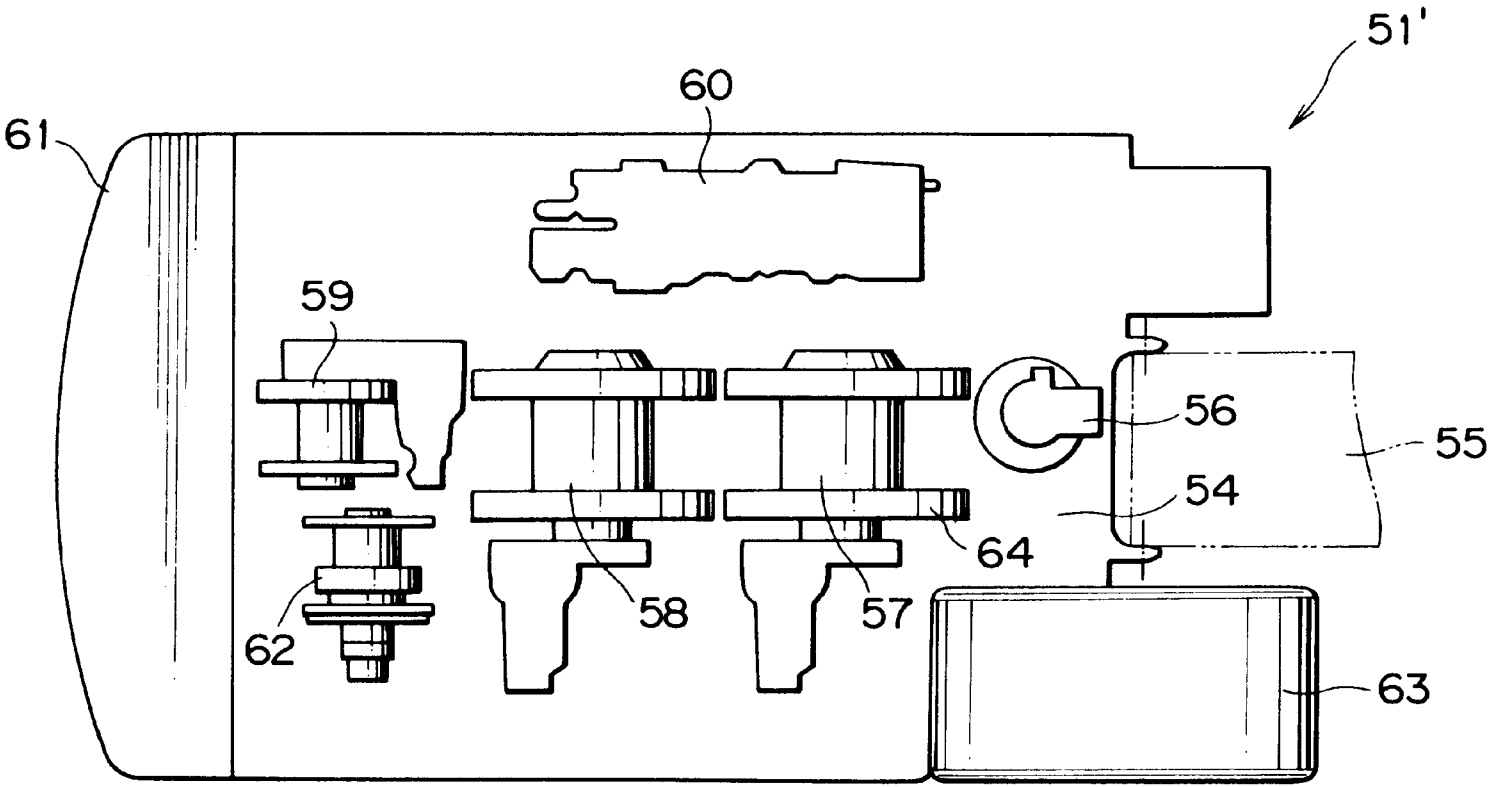
FIG. 12 PRIOR ART
FIG. 12 is a plan view showing a schematic constitution of a crawler crane according to a further example of a conventional crawler crane.
Figure 13:
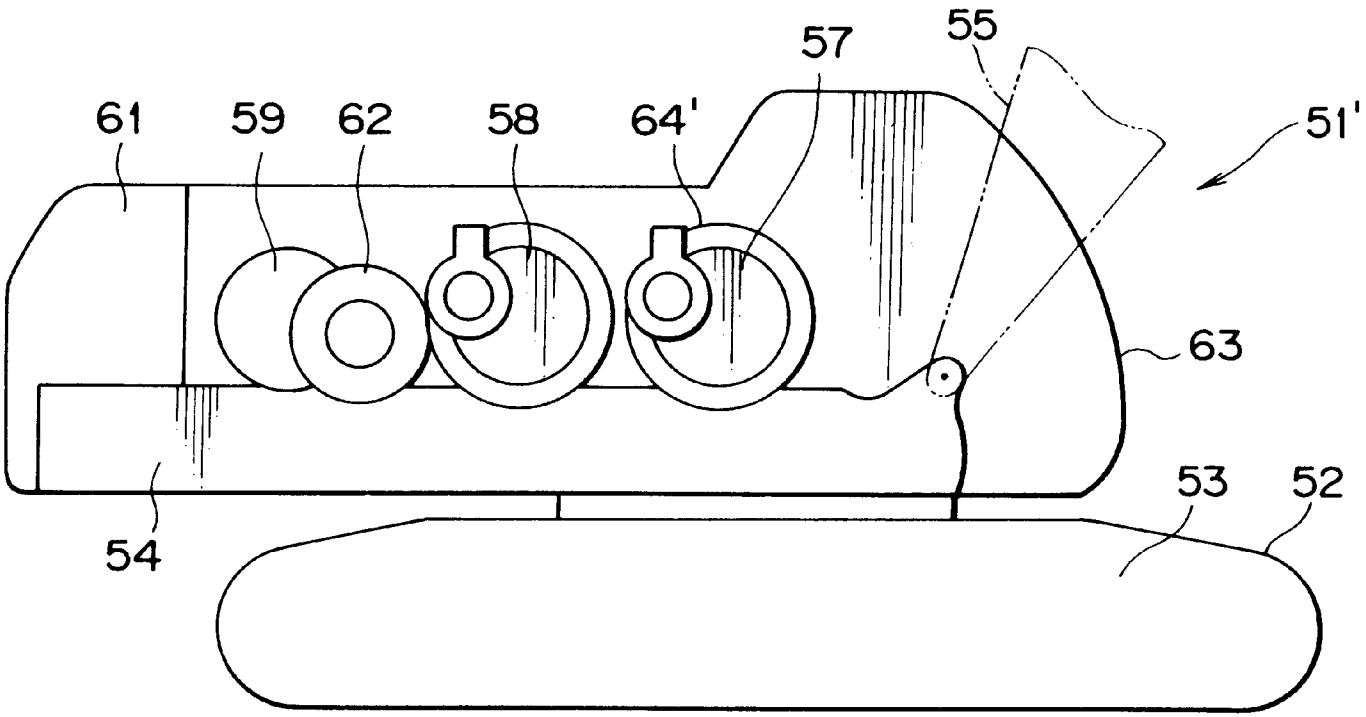
FIG. 13 PRIOR ART
FIG. 13 is a side view showing a schematic constitution of a crawler crane according to another example of a conventional crawler crane.
Figure 14A:
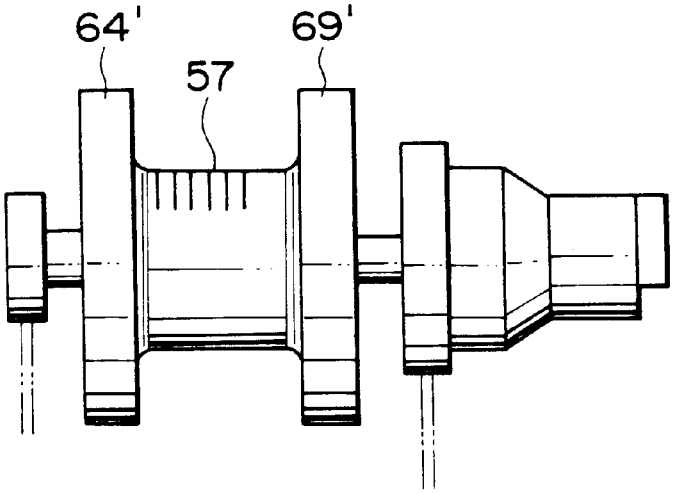
FIG. 14A PRIOR ART
FIGS. 14A and 14B are respectively a fragmentary enlarged view of a main winding drum according to another example of a conventional crawler crane.
Figure 14B:
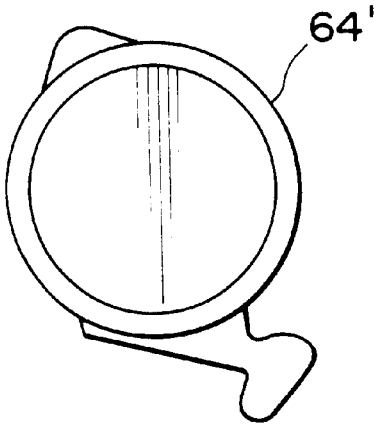
FIG. 14B PRIOR ART

Other embodiments of the present invention are shown in FIGS. 5 to 8. For example, FIG. 5 shows an arrangement wherein a dry double brake is provided on each drum, and each drum is bolted; FIG. 6 shows an arrangement wherein a wet brake is provided on each drum, and each drum is pinned; FIG. 7 shows an arrangement wherein a wet brake is provided on each drum, and the engine is mounted to left; and FIG. 8 shows an arrangement wherein a wet brake is provided on each drum, and the engine is mounted to right. Alternatively, as in these figures, the main winding drum 3, the auxiliary winding drum 4 and the third drum 5 having the same shape are arranged and mounted in a row, and a small third drum 15 is further mounted. Other reference numerals indicate the elements similar to those of FIG. 1. The present invention can be also applied to a crane of the vessel mounting type.

We claim:

1. A crawler crane comprising:

a revolving frame;

a main winding drum, an auxiliary winding drum and a third drum mounted on said revolving frame to wind an operating rope, said respective drums being arranged in a row so that their rotational shafts are at right angles to a center axis of a boom and mounted on said revolving frame;

an engine including a power plant for supplying driving pressure oil to said main winding drum, said auxiliary winding drum and said third drum, said engine being mounted on either left or right side of said revolving frame and transversely of at least one of said main, auxiliary and third drums;

a counterweight having a recessed portion having a front side formed into a recessed surface, said counterweight being mounted at the rear of said main winding drum, said auxiliary winding drum and said third drum; and a fourth drum installed within said recessed portion.

2. The crawler crane according to claim 1, wherein at least one of said main winding drum, said auxiliary winding drum and said third drum is a drum with a wind-down free falling function.

3. A crawler crane comprising:

a revolving frame;

a main winding drum, an auxiliary winding drum and a third drum mounted on said revolving frame to wind an operating rope, said respective drums being arranged in a row so that their rotational shafts are at right angles to a center axis of a boom and mounted on said revolving frame;

an engine including a power plant for supplying driving pressure oil to said main winding drum, said auxiliary winding drum and said third drum, said engine being mounted on either left or right side of said revolving frame and transversely of at least one of said main, auxiliary and third drums;

a counterweight having a recessed portion having a front side formed into a recessed surface, said counterweight being mounted at the rear of said main winding drum, said auxiliary winding drum and said third drum;

a fourth drum installed within said recessed portion; and a brake provided on each of said drums to brake said main winding drum, said auxiliary winding drum and said third drum, said brake being encased in the respective drum.

4. The crawler crane according to claim 3, wherein at least one of said main winding drum, said auxiliary winding drum and said third drum is a drum with a wind-down free falling function.

5. A crawler crane in which a main winding drum, an auxiliary winding drum and a third drum for winding an operating rope are arranged in a row and mounted on a revolving frame so that their rotational shafts are at right angles to a center axis of a boom, characterized in that an engine including a power plant for supplying driving pressure oil to said main winding drum, said auxiliary winding drum and said third drum is mounted on either left or right side of said revolving frame and transversely of at least one of said main, auxiliary and third drums, a counterweight having a front side formed into a recessed surface is mounted at the rear of said main winding drum, said auxiliary winding drum and said third drum, and a fourth drum is installed within said recessed portion.

6. A crawler crane comprising:

a revolving frame;

a main winding drum, an auxiliary winding drum and a third drum mounted on said revolving frame to wind an operating rope, said respective drums being arranged in a row so that their rotational shafts are at right angles to a center axis of a boom and mounted on said revolving frame;

an engine including a power plant for supplying driving pressure oil to said main winding drum, said auxiliary winding drum and said third drum, said engine being mounted on either left or right side of said revolving frame and transversely of at least one of said main, auxiliary and third drums relative to said center axis;

a counterweight having a recessed portion having a front side formed into a recessed surface, said counterweight being mounted at the rear of said main winding drum, said auxiliary winding drum and said third drum; and a fourth drum installed within said recessed portion.

7. The crawler crane according to claim 6, wherein at least one of said main winding drum, said auxiliary winding drum and said third drum is a drum with a wind-down free falling function.

* * * * *